US006253920B1

(12) United States Patent
Källgren

(10) Patent No.: US 6,253,920 B1
(45) **Date of Patent: *Jul. 3, 2001**

(54) BLISTER PACK

(75) Inventor: Eva Källgren, Hägersten (SE)

(73) Assignee: AstraZeneca AB, Sodertalje (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/676,214

(22) PCT Filed: Jun. 20, 1996

(86) PCT No.: PCT/SE96/00810

§ 371 Date: Jul. 19, 1996

§ 102(e) Date: Jul. 19, 1996

(87) PCT Pub. No.: WO97/02192

PCT Pub. Date: Jan. 23, 1997

(30) Foreign Application Priority Data

Jun. 30, 1995 (SE) ..... 9502370

(51) Int. Cl.[7] ..... B65D 83/04
(52) U.S. Cl. ..... 206/532; 206/469
(58) Field of Search ..... 206/467, 469, 206/531, 532, 534, 539; 53/453; 425/383, 388

(56) References Cited

U.S. PATENT DOCUMENTS

| | | | | |
|---|---|---|---|---|
| 3,605,374 | * | 9/1971 | Mueller et al. | 53/453 |
| 3,659,706 | * | 5/1972 | Serrell | 206/532 |
| 3,743,084 | | 7/1973 | Douglas . | |
| 3,780,856 | * | 12/1973 | Braverman | 206/539 |
| 4,340,141 | | 7/1982 | Fischer . | |
| 4,571,924 | * | 2/1986 | Bahrani | 53/453 |
| 4,653,644 | * | 3/1987 | Sullivan et al. | 206/539 |
| 4,736,849 | * | 4/1988 | Leonard et al. | 206/534 |
| 5,014,851 | * | 5/1991 | Wick | 206/539 |
| 5,050,739 | * | 9/1991 | Hannan et al. | 206/531 |
| 5,366,685 | * | 11/1994 | Fujii et al. | 425/388 |
| 5,496,250 | * | 3/1996 | Fielder et al. | 53/453 |

FOREIGN PATENT DOCUMENTS

| | | |
|---|---|---|
| 0389207 | 9/1990 | (EP) . |
| 0563934 | 10/1993 | (EP) . |
| 0170367 | 11/1972 | (ES) . |
| 2224720 | 5/1990 | (GB) . |
| 2250978 | 6/1992 | (GB) . |
| 9427555 | 12/1994 | (WO) . |
| 9529202 | 11/1995 | (WO) . |

* cited by examiner

*Primary Examiner*—Jim Foster
(74) *Attorney, Agent, or Firm*—White & Case LLP

(57) ABSTRACT

A blister pack, comprising at least a first and a second parallel row of blisters, and of the type in which a base foil formed with blisters is connected to a substantially flat lid foil wherein between the at least first and second rows of blisters, an intermediate part having at least one folding line parallel to said first and second rows is defined, said pack being foldable along said folding line, and that said blisters of said frist row are so offset relative to the blisters of said second row that after folding the blisters in the rows engage between each other.

10 Claims, 1 Drawing Sheet

BLISTER PACK

The present invention relates to a blister pack, a method and an arrangement in manufacturing a blister pack, and a mould for manufacturing a base with blisters as well as a device in manufacturing the same.

BACKGROUND OF THE INVENTION

Blister packs for drugs in tablet form or in the form of powder or liquid enclosed in a capsule have been known for a long time. The blister pack consists of a flat sheets of foils covering each other and being attached to each other. One, relatively rigid foil, most commonly called the base, comprises cavities or open "blisters", for accommodating a tablet or capsule each, while the other foil is flat and most commonly called the lid, seals the opening of the cavities or blisters. The most commonly used sealing process is heat sealing, at least one of the foils having thermoplastic properties, and at present the manufacture of the pack is most rationally carried out by continuously joining webs of the foils for said sealing, and cutting them to said packs.

Examples of materials for the lid are hard aluminium, soft aluminium, paper, polyester, PVC, and examples of materials for the base are aluminium laminate, polypropylene, PVC/Aclar, PVC/PVDC. Different laminates as basic material for these foils are also known.

A plurality of blister packs are normally placed in an outer package, a box or carton, which constitutes a unit sold by, for instance, pharmacies. A blister pack may contain, for instance, a weekly dose of drugs and comprises seven blisters, each containing a daily dose, and the package may contain a four-week dose, i.e. four flat blister packs.

A problem with such conventional blister packs is that they are bulky and voluminous owing to the construction of the blisters, and therefore the package must be voluminous. The voluminous package involves heavy expenses, e.g. heavy expenses for the handling and transport and heavy stock-keeping expenses. Furthermore, due to its measures, e.g. large sides, the voluminous package will be rather unstable, which will also render the manufacturing and handling of the package difficult.

Another problem with the present package is the ability to reach the blister pack in the the package having engaging flaps and slits. The stability of the package, which is weakened by the lid opening, could cause the user to easily drop the package when taking a blister pack out of the package, whereby the rest of the blister packs in the package falls out.

Attempts have previously been made to reduce the volume requirement of the outer package, by packing the blister packs in pairs in a package, one blister side facing the other blister side. The term blister side refers to the bubble face of the blister pack, i.e. the face on which the blisters protrude. This has made it possible to arrange the lid of the box on one side of the box, one short side. However, by this arrangement a new problem occurs. The blister side of the blister pack being pulled out of the box takes along the blister pack whose blister side faces the blister side of the pack that is being pulled out. Furthermore, the packing of identical blister packs facing each other in pairs will cause the blister packs to be offset with respect to each other. A stack of such blister packs will present free edges, which can easily be damaged during handling or transport.

Besides, in case of an odd number of blisters in a blister pack, the centre of gravity of the blister pack will be offset relative to the centre of symmetry, which may cause problems during the packing phase of the manufacture of the blister packs. There is a great risk that the blister pack will be askew, whereby some of the blisters will be damaged.

THE INVENTION

The object of the invention is to find a solution to the above described problems.

This object is achieved by the blister pack according to the accompanying claims.

In addition to the solution of the above-mentioned problems, the invention or its embodiments confer the following advantages which are not possible to obtain by using the prior-art technique.

The contents of the blisters are protected in a more satisfactory manner.

The protective casing, the box, can even be dispensed with, and the blister packs can be held together by, for example, a shrink wrapping, with retained satisfactory protection of the blisters.

The blister pack is easier to handle in a machine during manufacture,since the blisters are concealed after folding, and the folded pack is more stable. For example, it is easier to count and pack the folded packs.

BRIEF DESCRIPTION OF THE DRAWINGS

The invention will now be described in more detail with reference to the accompanying drawings.

DETAILED DESCRIPTION OF THE DRAWINGS

Figure 1:
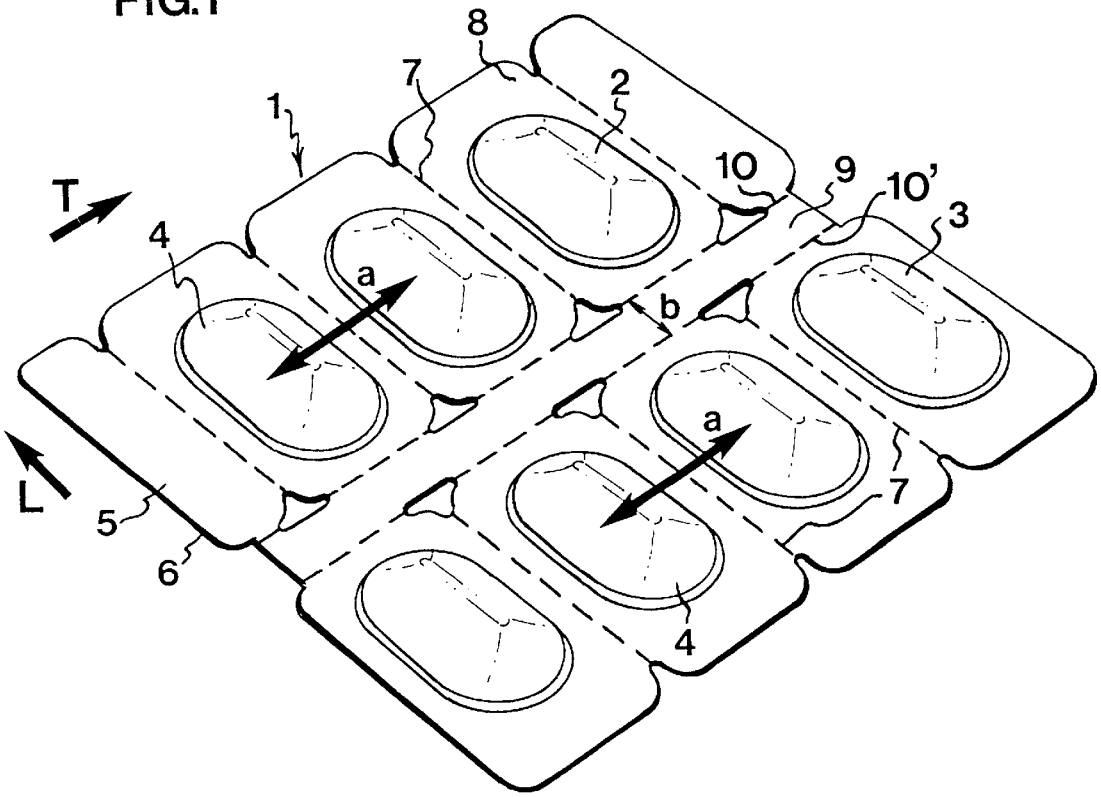
FIG. 1 illustrates a blister pack according to the invention in lay-flat condition.

The blister pack 1 in the Figures has two rows 2, 3 of the same oval blisters 4 containing drugs. In a preferred embodiment, the oval shape is to be found in the longitudinal direction L, whereas the shape in the transverse direction T is substantially a circular arc. The blisters of each row have the same mutual distance a. which is the same in both rows. The base foil 5 and the lid foil 6 can have perforations 7, such that individual blister units 8 containing a dose of the drug involved can be separated from the blister pack 1. The drug in the blister 4 can be taken out by the known peel-off method, thereby separating the lid foil from the base foil, or by breaking off the lid foil 6 in front of the relevant blister. In this embodiment, there are three blisters in one row and four in the other, one blister containing a daily dose.

Figure 2:
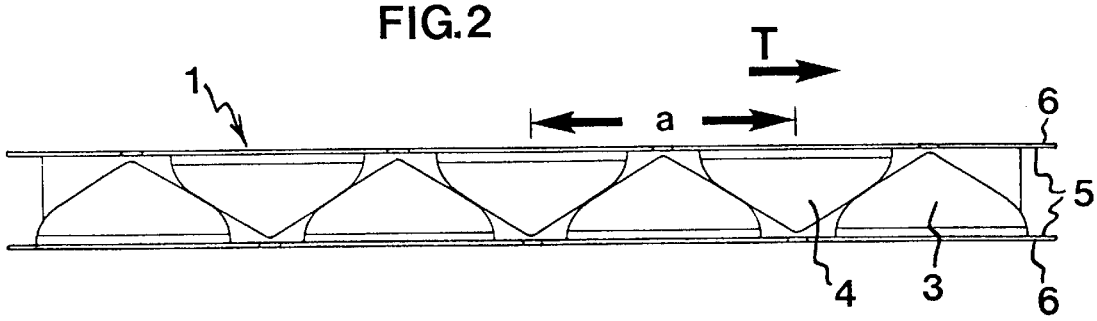
FIG. 2 illustrates the blister pack in FIG. 1 in folded condition when stacked in a package together with other blister packs of the same kind.

The two rows 2, 3 are separated by an intermediate part free of blisters, a web 9, whose width b is defined by two parallel grooves 10, 10' in the blister pack, said grooves extending between the rows 2, 3 and consisting of, for instance, perforations or scores. The width b is selected such that when the two rows 2, 3 of blisters are folded towards one another along the two grooves 10, 10', the blisters 4 of one row engage between the blisters 4 of the other row 3. In one preferred embodiment, the blisters 4 are, as shown in one row 2, offset relative to the blisters in the other row 3 by the distance 0.5 a, and the height of the blisters 4 substantially corresponds to the distance b. The thus folded state is illustrated in FIG. 2.

It will be appreciated that a plurality of such folded blister packs 1 can be packed, stacked on each other, in a package which is openable from one end surface or side wall, and that one blister pack can be pulled out of the package, without pulling along other blister packs packed in the package.

In a preferred embodiment, the blister pack according to the invention is used for a pharmaceutically active drug, such as omeprazole.

It will also be obvious that the shape of the blisters need not be oval, as in the example above, for achieving the objects and advantages of the invention. The blisters may be, for instance, semicircular also in the longitudinal direction L. Further, it will be obvious that the inventive idea is applicable to all sorts of materials in the base foil and the lid foil, as well as to an optional number of blisters in a blister pack, as long as the blisters are arranged in at least two rows. The invention is thus intended to cover blister packs which can be packed in a meandering manner. Further, the above lid foil may be stiffened by e.g. a piece of breakable and co-foldable board of equal size, eliminating the need for packaging. Naturally, one or more grooves may separate more than two blister rows from each other. The expression "row of blisters" is also intended to include a single blister in one of the at least two rows of blisters.

It will be appreciated that the blister pack can consist of at least two differently shaped sets of blisters, each set containing a different drug. This type of blister pack is especially useful for packing, in one blister pack, two drugs that should be administered in combination, for example omeprazole and antibiotics.

A machine for manufacturing the blister pack according to the invention can be of conventional type, however supplemented with means for preparing the grooves 10, 10', and of course comprising a mould provided with cavities which are positioned in the mould so as to produce the above described blister pattern in the base foil/web.

It will also be obvious that the invention is applicable to all prior-art methods for manufacturing blister packs. Such prior-art methods require merely that the blisters in two neighbouring rows of blisters be offset and the grooves 10, 10' be prepared, thereby making it possible to fold the blister pack as described above.

What is claimed is:

1. A blister pack comprising at least a first and second row of blisters, wherein the rows of blisters are parallel to each other and the blister pack is of the type in which a base foil formed with blister cavities is connected to a substantially flat lid foil characterized in that between the rows, an intermediate part having at least two folding lines parallel to said rows is defined, said pack being foldable along said folding lines, wherein each blister has a generally wedge-shaped top surface, and the blisters of the first row are so offset relative to the blisters of the second row such that after folding the pack, the blisters in the first row are interposed between the blisters of the second row and the surface of adjacent blisters in the rows contactingly engage and partially overlie each other, and wherein the height of the blisters substantially corresponds to the distance between the outer folding lines.

2. The blister pack according to claim 1, wherein the folding lines are defined by perforations or scores in said foils.

3. The blister pack according to claim 1 or 2, wherein the distance between the blisters of one row is equal to the distance between the blisters of the other row.

4. The blister pack according to claim 3, wherein perforations are provided such that individual blister units containing a dose of a drug are separable from the blister pack.

5. The blister pack according to claim 4, wherein the lid foil is separable from the base foil by peeling.

6. The blister pack according to claim 5, wherein the shape of the blisters is oval.

7. The blister pack according to claim 5, wherein the shape of the blisters is circular.

8. The blister pack according to claim 7, wherein four blisters are in one row and three blisters are in the other row.

9. The blister pack according to claim 7, wherein three blisters are in one row and two blisters are in the other row.

10. The blister pack according to claim 5, wherein at least two sets of blisters are present: one set containing a drug to be administered in combination with a drug contained in the other set, wherein the blisters of the first set are oval and the blisters of the other set are circular.

* * * * *